US010848843B2

(12) United States Patent
Wang

(10) Patent No.: US 10,848,843 B2
(45) **Date of Patent: *Nov. 24, 2020**

(54) SPEAKER BOX

(71) Applicant: AAC Technologies Pte. Ltd., Singapore (SG)

(72) Inventor: Tong Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 16/529,823

(22) Filed: Aug. 2, 2019

(65) Prior Publication Data

US 2020/0053442 A1 Feb. 13, 2020

(30) Foreign Application Priority Data

Aug. 10, 2018 (CN) ..... 2018 2 1303529 U

(51) Int. Cl.

| | |
|---|---|
| ***H04R 1/02*** | (2006.01) |
| ***H04R 9/06*** | (2006.01) |
| ***H04R 9/02*** | (2006.01) |

(52) U.S. Cl.

CPC ..... *H04R 1/025* (2013.01); *H04R 1/023* (2013.01); *H04R 9/025* (2013.01); *H04R 9/06* (2013.01); *H04R 2499/11* (2013.01)

(58) Field of Classification Search

CPC ..... H04R 1/025; H04R 1/023; H04R 9/025; H04R 9/06; H04R 2499/11

See application file for complete search history.

(56) References Cited

U.S. PATENT DOCUMENTS

2009/0245565 A1* 10/2009 Mittleman ..... H04R 1/28 381/365
2019/0098385 A1* 3/2019 Han ..... H04R 9/02

* cited by examiner

*Primary Examiner* — Ping Lee
(74) *Attorney, Agent, or Firm* — W&G Law Group LLP

(57) ABSTRACT

A speaker box includes a housing having a receiving space; a sound generator having a diaphragm received in the receiving space for vibrating along a vibration direction; a sound aperture formed in the housing for communicating the sound generator with an outside of the speaker box; a dustproof member positioned by the housing and covering completely the sound aperture. The dustproof member includes a first dustproof element fixed to the housing and completely covering the sound aperture; a second dustproof element fixed to the housing; a gasket plate sandwiched between the first and second dustproof elements. The gasket forms a through hole aligned with the sound aperture and completely covered by the second dustproof element.

7 Claims, 2 Drawing Sheets

SPEAKER BOX

FIELD OF THE PRESENT DISCLOSURE

The present disclosure relates to the field of electromagnetic transducers, more particularly to a speaker box used in a portable electronic device.

DESCRIPTION OF RELATED ART

A speaker box is a very important component equipped in a mobile phone for producing audible sounds. A speaker box generally uses a diaphragm to produce vibration and further to generate sounds.

In order to adapt to miniaturization and multifunctional development of various audio equipment and information communication equipment, the speaker box used in the equipment is more likely to be more miniaturized. The matching of other elements on the periphery of the loudspeaker is more compact. The vibration system and the magnetic circuit system of the speaker are directly connected with the sound quality of the speaker. The vibration system of a related speaker comprises a vibrating diaphragm and a voice coil assembly attached to the vibrating diaphragm. The magnetic circuit system comprises a yoke and a magnet arranged in the yoke. When the speaker box is equipped in a mobile phone, a sound aperture of the speaker box should be protected by a dustproof member from outside dust. The sound aperture with the dustproof member should be assembled with the housing of the mobile phone. More and more mobile phones are using housing made of glass, which makes it difficult to assemble the speaker box with the housing by insert-molding process. Therefore, an improved speaker box is desired.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

Figure 1:
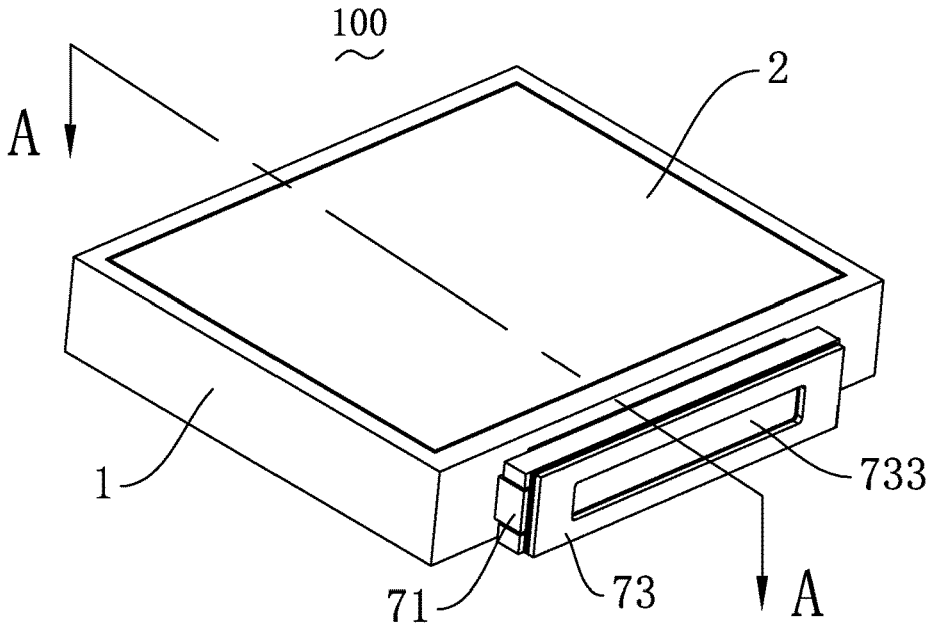
FIG. 1 is an isometric view of a speaker box in accordance with a exemplary embodiment of the present disclosure.

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby are only to explain the disclosure, not intended to limit the disclosure.

Referring to FIGS. 1-4, a speaker box 100 includes an upper cover 1, a lower cover 2, a sound generator 3 with a sound aperture 4, a supporting wall 5 and a dustproof member 7.

The upper cover 1 and the lower cover 2 cooperatively form a receiving space 10. The sound generator 3 divides the receiving space 10 into a front sound cavity 6 and a back cavity 101. In detail, the sound generator 3 and the upper cover 1 form the front sound cavity 6, and the sound generator 3 forms the back cavity 101 together with the upper cover 1 and the lower cover 2.

The sound aperture 4 is formed in the upper cover in the embodiment. A housing is formed by the upper cover 1 and the loser cover 2. The upper cover 1 forms a sound passageway 102 for communicating the front sound cavity 6 and the sound aperture 4 to perform a side-sound configuration. The side-sound configuration is capable of radiating the sounds produced by the sound generator along a direction perpendicular to a vibration direction of a diaphragm of the sound generator. The back cavity 101 is used to improve the low frequency acoustic performance.

The supporting wall 5 is located inside the upper cover 1 and extends toward the lower cover 2. In the embodiment, the supporting wall 5 is ring-shaped for positioning the sound generator 3. Thereby the front sound cavity 6 is formed by the sound generator 3 supported by the supporting wall 5 together with the upper cover 1. For improving the stability of the supporting wall 5, the supporting wall 5 is integrally formed with the upper cover 1.

An extension direction of the sound aperture 4 is perpendicular to the vibration direction.

Figure 2:
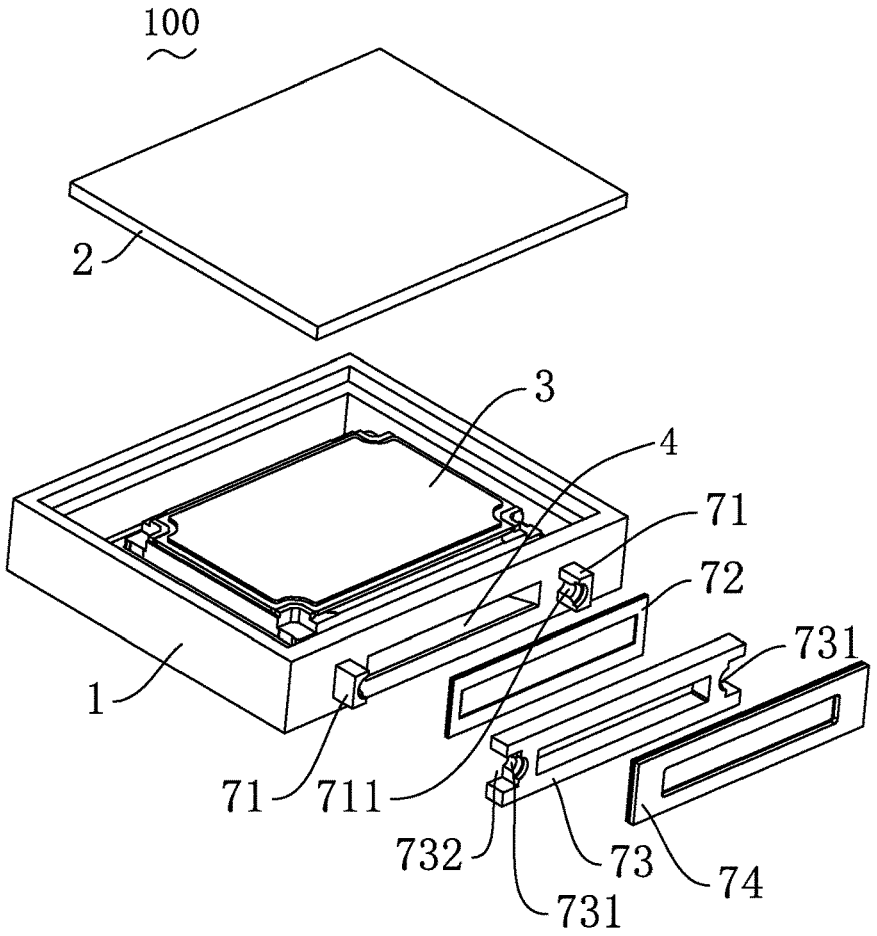
FIG. 2 is exploded view of the speaker box in FIG. 1.
Figure 3:
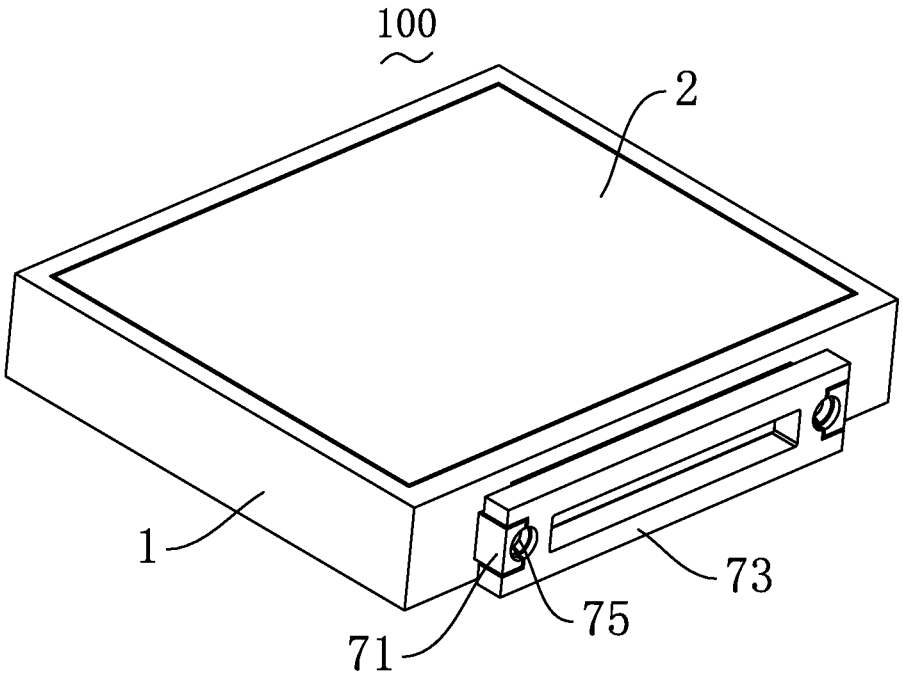
FIG. 3 is a partially exploded view of the speaker box.
Figure 4:
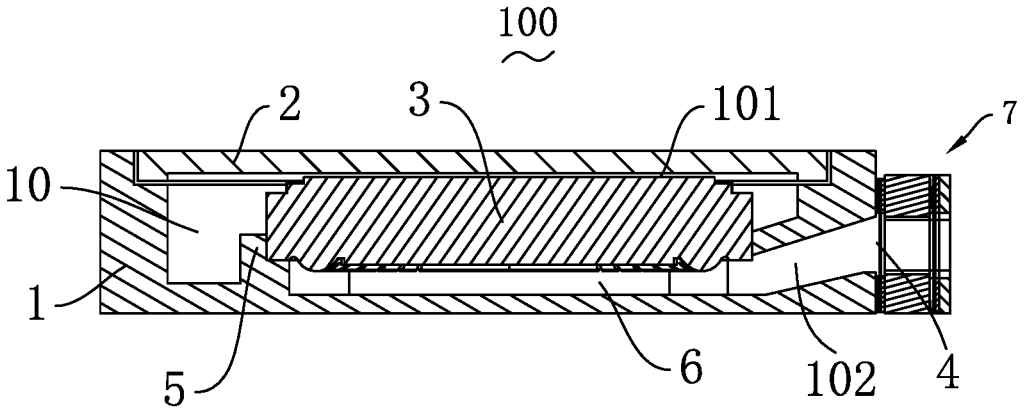
FIG. 4 is a cross-sectional view of the speaker box taken along line A-A in FIG. 1.

The dustproof member 7 is located at an end of the sound aperture 4, which makes it easy to assemble the dustproof member 7 with a housing of a mobile phone. Referring to FIGS. 2-4, the dustproof member 7 includes a pair of positioning protrusions 71 located at two sides of the sound aperture 4, a first dustproof element 72 covering the sound aperture 4 and located between the two positioning protrusions 71, a gasket plate 73 abutting against the first dustproof element 72 with two ends thereof engaging with the positioning protrusions 71, and a second dustproof element 74 abutting against the gasket plate 73, by which the gasket plate 73 is sandwiched between the first and second dustproof elements 72, 74. Each of the positioning protrusions 71 forms a first recess 711 adjacent to the sound aperture 4, and the gasket plate 73 forms a second recess 73 corresponding to the first recess 711. The first recess and the second recess 71, 731 are used to form a glue-receiving slot 75 for firmly positioning the gasket plate 73 and the positioning protrusions 71.

In the embodiment, two ends of the gasket plate 73 respectively form a each of two ends of the gasket plate includes a 732 for engaging with the positioning protrusion 71. The second recess 731 is formed in the locking slot 732. The glue-receiving slot 75 is configured to be a step-hole meaning a hole with a greater inner diameter at a top portion thereof and a smaller inner diameter at a lower part thereof, for improving the engaging force between the gasket plate 73 and the positioning protrusion 71.

In order to positioning the second dustproof element 74, an outer surface of the gasket plate 73 is coplanar with the top surface of the positioning protrusion 71, which makes the glue in the glue-receiving slot 75 engage with the second dustproof element more effectively.

In the embodiment, the positioning protrusion is integrally formed with the upper cover 1 at a portion where the sound aperture 4 is formed. The gasket plate 73 forms a through hole 733 aligned with the sound aperture 4.

Compared to the related art, the speaker box of the present disclosure includes two dustproof elements engaged with each other via the glue in the glue-receiving slot and the engagement between the positioning protrusions and the gasket plate, for assembling the dustproof member firmly with the housing of the mobile phone. Even if the housing of the mobile phone is made of glass, the combination between the dustproof member and the housing is still stable and firm.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box, comprising:

a housing having a receiving space, the housing including an upper cover and a lower cover cooperatively forming the receiving space;

a sound generator having a diaphragm received in the receiving space for vibrating along a vibration direction, the sound generator forming a front sound cavity together with the upper cover;

a sound aperture formed in the housing for communicating the sound generator with an outside of the speaker box, the upper cover forming a sound passageway communicating the front sound cavity with the sound aperture;

a dustproof member positioned by the housing and covering completely the sound aperture;

wherein the dustproof member includes:

a first dustproof element fixed to the housing and completely covering the sound aperture;

a second dustproof element fixed to the housing;

a gasket plate sandwiched between the first and second dustproof elements, the gasket forming a through hole aligned with the sound aperture and completely covered by the second dustproof element, the speaker box further comprises a pair of positioning protrusions extending from the housing and located at two sides of the sound aperture for positioning the gasket plate therebetween.

2. The speaker box as described in claim 1, wherein the sound aperture extends along a direction perpendicular to the vibration direction for performing side-sounding.

3. The speaker box as described in claim 1, wherein the first dustproof element locates between the two positioning protrusions.

4. The speaker box as described in claim 1, wherein each of two ends of the gasket plate includes a locking slot recessed toward the through hole for engaging with the corresponding positioning protrusion.

5. The speaker box as described in claim 1, wherein the positioning protrusion forms a first recess adjacent to the sound passageway; the gasket plate forms a second recess corresponding to the first recess; and the first recess and the second recess cooperatively form a glue-receiving slot for accommodating glue therein.

6. The speaker box as described in claim 5, wherein the glue-receiving slot is a step-hole.

7. The speaker box as described in claim 5, wherein the second dustproof element is fixed to the gasket plate by virtue of the glue received in the glue-receiving slot.

* * * * *